US011236433B2

(12) United States Patent
Ayres et al.

(10) Patent No.: US 11,236,433 B2
(45) Date of Patent: Feb. 1, 2022

(54) APPARATUS AND METHOD FOR PROCESSING A SUBSTRATE

(71) Applicant: SPTS Technologies Limited, Newport (GB)

(72) Inventors: Martin Ayres, Bulwark (GB); John MacNeil, St. Nicholas (GB); Trevor Thomas, Rhiwbina (GB)

(73) Assignee: SPTS Technologies Limited, Newport (GB)

( * ) Notice: Subject to any disclaimer, the term of this patent is extended or adjusted under 35 U.S.C. 154(b) by 0 days.

(21) Appl. No.: 16/845,487

(22) Filed: Apr. 10, 2020

(65) Prior Publication Data

US 2020/0325588 A1 Oct. 15, 2020

(30) Foreign Application Priority Data

Apr. 11, 2019 (GB) ..... 1905138

(51) Int. Cl.
*C25D 7/12* (2006.01)
*C25D 21/10* (2006.01)
(Continued)

(52) U.S. Cl.
CPC ..... *C25D 17/001* (2013.01); *C25D 7/12* (2013.01); *C25D 17/004* (2013.01); *C25D 21/10* (2013.01); *C25D 21/12* (2013.01)

(58) Field of Classification Search
CPC . C25D 21/10; C25D 7/12–123; C25D 17/001
See application file for complete search history.

(56) References Cited

U.S. PATENT DOCUMENTS 5,553,994 A * 9/1996 Biche ..... H01L 21/67017 198/750.12
6,251,250 B1 6/2001 Keigler
(Continued)

FOREIGN PATENT DOCUMENTS

EP 2652178 A2 10/2013
EP 2781630 A1 9/2014
(Continued)

OTHER PUBLICATIONS

Song et al., Machine Translation, KR 10-2014-0003812 A (Year: 2014).*

(Continued)

*Primary Examiner* — Ho-Sung Chung
(74) *Attorney, Agent, or Firm* — Hodgson Russ LLP

(57) ABSTRACT

An apparatus for electrochemically processing a semiconductor substrate includes a processing chamber of the type that is sealable to a peripheral portion of a semiconductor substrate so as to define a covered processing volume. The semiconductor substrate is supported by a substrate support. A magnetic arrangement is disposed outside of the processing chamber and produces a magnetic field. The magnetic field is changed using a controller for controlling the magnetic arrangement. An agitator is disposed within the processing chamber. The agitator comprises a magnetically responsive element which is responsive to changes in the magnetic field of the magnetic arrangement so as to provide a reciprocating motion to the agitator.

17 Claims, 3 Drawing Sheets

(51) Int. Cl.
*C25D 17/00* (2006.01)
*C25D 21/12* (2006.01)

(56) References Cited

U.S. PATENT DOCUMENTS

| | | | | |
|---|---|---|---|---|
| 2003/0230385 | A1 | 12/2003 | Bach et al. | |
| 2013/0306465 | A1* | 11/2013 | Zimmerman | F16J 15/00 204/242 |
| 2015/0090298 | A1 | 4/2015 | Nagashima et al. | |
| 2017/0088972 | A1* | 3/2017 | Stone | C25F 3/00 |

FOREIGN PATENT DOCUMENTS

| | | | | |
|---|---|---|---|---|
| EP | 3352206 | A1 | 7/2018 | |
| KR | 1020140003812 | A * | 1/2014 | C23C 16/06 |

OTHER PUBLICATIONS

Ika, Magnetic Stirrers (Year: 2016).*
IPO, Office Action for GB Application No. 1905138.2, dated Jan. 9, 2020.

* cited by examiner

APPARATUS AND METHOD FOR PROCESSING A SUBSTRATE

CROSS-REFERENCE TO RELATED APPLICATIONS

This application claims priority to GB 1905138.2 filed Apr. 11, 2019, the disclosure of which is hereby incorporated by reference.

FIELD OF THE DISCLOSURE

This invention relates to an apparatus for electrochemically processing a semiconductor substrate, in particular, an apparatus for electrochemically processing a front face of a semiconductor substrate. This invention also relates to methods of processing a semiconductor substrate, including electrochemically processing a semiconductor substrate and electrochemical deposition onto a semiconductor substrate.

BACKGROUND OF THE DISCLOSURE

Electrochemical deposition (also known as electrodeposition or electroplating) is used in the manufacture of printed circuit boards (PCB), semiconductor devices, and flat panel displays (FPD) to deposit metal coatings onto a conductive substrate. To achieve an acceptable deposit the deposition characteristics, such as deposition uniformity and deposition rate, must be carefully controlled.

An important factor that determines the deposition characteristics (e.g. uniformity and rate) of an electrochemical deposition process is the mass transport of material to the surface of substrate being coated. The rate of mass transport of material to the electrode surface is correlated to the current density and hence deposition rate during an electrochemical deposition process. The deposition rate is limited by the maximum current density, which is determined by the diffusion boundary layer thickness (also referred to as 'diffusion layer' thickness) at the surface of the substrate. As the diffusion boundary layer thickness decreases, the rate of mass transport of material to the substrate surface increases, which results in an increased current density and deposition rate. The thickness of the diffusion boundary layer (and hence the deposition rate) can be controlled by controlling the flow of electrolyte across the substrate surface, for example, by electrode movement (such as rotation), fluid agitation by bubbles, ultrasonic vibration or mechanical movement. Faster mass transport generally results in higher deposition rates.

The semiconductor and related industries, such as LED and FPD manufacture, requires electrochemical deposition (ECD) systems to be cost effective. In order to achieve excellent cost of ownership (CoO), ECD systems in these fields require excellent process capabilities, high deposition rates with good uniformity control, and a reliable and repeatable operation at low operating costs. This is particularly the case for applications which require relatively thick coatings or films, for example more than a few microns. It is therefore desirable to improve the deposition rate of an ECD process, whilst maintaining good uniformity control in a reliable and repeatable manner.

The running cost of an ECD system is also evaluated based on the tool footprint. Due to the high cost of wafer fabrication space, the tool footprint of ECD systems should be minimised, whilst maximising the productivity of the system.

EP3352206 discloses an apparatus for processing a front face of a semiconductor wafer comprising a vertical stack of wafer processing modules, which aims to maximise productivity while minimising tool footprint by minimising the height of and spacing between adjacent wafer processing modules. This enables a greater number of processing modules to be stacked in a fixed (vertical) space. Processing chambers of the type that define a covered processing volume (also referred to as a 'closed' processing chambers) do not require bulky hardware to be positioned above the chamber (e.g. for substrate loading/unloading), and therefore allow adjacent processing modules to be stacked with a smaller vertical separation between them. However, when using a covered or 'closed' processing module of this type, it becomes more challenging to form a reliable seal against any moving parts. Leaks can occur where the fluid seal is not adequately formed, which can lead to contamination issues. Additionally, as the height of the wafer processing module is reduced, it becomes more challenging to maintain efficient mixing of the electrolyte near the substrate surface. Poor mixing can result in a non-uniform deposition and lower deposition rates.

There is therefore a desire to avoid leaks in processing chambers comprising moving parts. There is also a desire to improve the mixing of electrolyte in an electrochemical processing chamber, in particular a low-height, low volume chamber to increase deposition rate and deposition uniformity.

BRIEF SUMMARY OF THE DISCLOSURE

The present invention, in at least some of its embodiments, seeks to address at least some of the above described problems, desires and needs. In particular, the present invention, in at least some of its embodiments, provides at least one of: a high deposition rate, good deposition uniformity; and efficient mixing of electrolyte, which is particularly beneficial in low-volume, low-height electrochemical processing chambers. Additionally, the present invention, in at least some of its embodiments, provides an apparatus that provides a more reliable fluid seal for moving parts.

According to a first aspect of the invention there is provided an apparatus for electrochemically processing a semiconductor substrate, the apparatus comprising:

a processing chamber of the type that is sealable to a peripheral portion of a semiconductor substrate so as to define a covered processing volume;

a substrate support for supporting the semiconductor substrate;

a magnetic arrangement disposed outside of the processing chamber, the magnetic arrangement producing a magnetic field;

a controller for controlling the magnetic arrangement so as to change the magnetic field; and an agitator disposed within the processing chamber, the agitator comprising a magnetically responsive element which is responsive to changes in the magnetic field of the magnetic arrangement so as to provide a reciprocating motion to the agitator.

A processing chamber of the type that is sealable to a peripheral portion of a semiconductor substrate so as to define a covered processing volume may be referred to as a "closed" processing chamber. The expression "closed processing chamber" corresponds to a chamber that has a substantially sealed processing volume. It is understood that such closed processing chambers typically require certain openings or orifices in order for processing steps to be performed. For example, a closed processing chamber typically comprises one or more fluid inlets for introducing fluid into the processing volume and/or one or more fluid outlets for draining fluid from the processing volume.

Providing an agitator within the processing chamber helps to increase the rate of mass transport to the semiconductor substrate surface during processing. The magnetic arrangement, which is coupled to the magnetically responsive element, enables a reciprocating motion to be applied to the agitator without needing bulky hardware above or below the processing chamber. Consequently, efficient agitation and mixing of electrolyte can be achieved even in low height, low volume processing chambers. This has the further benefit of allow compact stacking of multiple apparatus. Furthermore, using a magnetic arrangement to magnetically couple to the agitator removes mechanically moving parts extending through the chamber walls, which would otherwise need to be sealed. This inherently reduces the likelihood of leakages and therefore contamination.

The magnetically responsive element may comprise at least one permanent magnet. The at least one permanent magnet may be a plurality of permanent magnets. The magnetically responsive element may comprise a magnetic array, such as a magnetic array of permanent magnets. The magnetically responsive element may comprise an electromagnet. The magnetic coupling between the magnetic arrangement and the magnetic responsive element is stronger where the magnetically responsive element can produce its own magnetic field. The magnetically responsive element may produce a magnetic field. The magnetic field of the magnetic arrangement may be arranged to be magnetically coupled to the magnetic field of the magnetically responsive element. The polarity of the magnetic arrangement may be opposite to the polarity of the magnetically responsive element to which it is magnetically coupled.

The magnetically responsive element may be responsive to changes in the position of the magnetic field of the magnetic arrangement. The magnetically responsive element may be responsive to changes in the magnitude of the magnetic field of the magnetic arrangement.

The magnetically responsive element may be responsive to changes in the magnetic field through a side wall of the processing chamber. Using magnetic coupling through the side wall helps to prevent the magnetic field influencing the processing step, such as an electrochemical deposition step. The magnetically responsive element may be disposed adjacent an inward face of the side wall of the processing chamber. The magnetic arrangement may be disposed adjacent to an outward face of the side wall of the processing chamber. Such a configuration allows the magnetically responsive element to be responsive to changes in the magnetic field through the side wall. The side wall through which the magnetically responsive element is responsive to changes in the magnetic field may have a thickness of less than the thickness of another side wall of the processing chamber. This affords stronger magnetic coupling through the side wall. The side wall through which the magnetically responsive element is responsive to changes in the magnetic field may have a thickness of 3-10 mm, preferably about 5 mm. Optionally, the magnetically responsive element may be responsive to changes in the magnetic field through a top or bottom wall of the processing chamber. The top or bottom wall of the processing chamber may be, for example, a lid, the substrate support or the semiconductor substrate. The magnet arrangement may be positioned above or below the processing chamber (e.g. adjacent the top or bottom wall) so that the magnetic arrangement can magnetically couple to the magnetically responsive element through the top or bottom of the processing chamber.

The magnetically responsive element and the magnetic arrangement may have a separation of less than 30 mm, less than 25 mm, less than 20 mm, or less than 10 mm.

The agitator may comprise two magnetically responsive elements arranged to be adjacent to opposing side walls of the processing chamber, wherein each magnetically responsive element is responsive to changes in the magnetic field of the magnetic arrangement so as to provide a reciprocating motion to the agitator. Typically, the two magnetically responsive elements are at diametrically opposed positions on the agitator. Arranging two magnetically responsive elements and the magnetic arrangement in this way enables stronger magnetic coupling to be achieved. Additionally, a more evenly powered agitator actuation is achieved.

The magnetic arrangement may comprise a permanent magnet, an electromagnet, or a magnetic array. The magnetic arrangement may comprise an arrangement of two or more permanent magnets, electromagnets and/or magnetic arrays. The two or more permanent magnets, electromagnets and/or magnetic arrays may be arranged to be adjacent to opposing side walls of the processing chamber. The magnetic arrangement may correspond to the arrangement of the two magnetically responsive elements so that magnetic coupling can occur through each of the opposing side walls. Each magnetically responsive element may be responsive to changes in the magnetic field of at least one of the two permanent magnets, electromagnets or magnetic arrays so as to provide a reciprocating motion to the agitator.

The agitator may be a paddle assembly. The agitator may further comprise at least one paddle. The at least one paddle may be a plurality of paddles. Typically, the reciprocating motion has a direction that is substantially orthogonal to a face of the at least one paddle. Preferably, adjacent paddles in the plurality of paddles may be spaced apart by a substantially regular spacing. The plurality of paddles may be supported on a frame. The frame may be substantially annular.

The agitator may comprise a tab that is received by a complementary portion of the processing chamber to support the agitator. The complementary portion of the processing chamber may be a part of a side wall of the processing chamber. The complementary portion of the part of the side wall may be recessed. The complementary portion of the processing chamber may comprise a step, wherein the tab is received by and is supported on the step. The tab may be supported on the frame. In embodiments comprising a paddle, each paddle may comprise at least one tab that is received by a complementary portion of the processing chamber. Each paddle may comprise a tab at each end of the paddle. The tab or tabs may support the agitator above the semiconductor substrate during processing so that the agitator is spaced apart from the semiconductor substrate during processing. The tabs enable the agitator and the semiconductor substrate during processing to have a controlled spacing between them. This prevents the agitator from contacting the semiconductor substrate, which would damage the substrate being processed. Additionally, the tabs provide for a consistent spacing between the agitator and the semiconductor substrate during processing. For example, the agitator can be positioned and maintained to within several millimetres of the substrate during processing. Maintaining a consistent position of the agitator with respect to the substrate helps to improve deposition uniformity and deposition rate in an electrochemical deposition process.

The tab may comprise the magnetically responsive element.

The agitator may be made from a metallic material, such as titanium, platinum coated titanium; a dielectric material; or a plastic material, for example polyvinyl chloride (PVC).

The substrate support may be of the type for supporting the semiconductor substrate substantially horizontally thereon. Optionally, the substrate support may be of the type for supporting the semiconductor substrate with a front face of the semiconductor substrate to be processed facing upwards.

The processing chamber may have a cross-sectional dimension of less than 500 mm, preferably less than 300 mm, or less than 200 mm. For example, the cross-sectional dimension may be from the top wall to the bottom wall of the processing chamber. The cross-sectional dimension may be a height.

The controller may be a user interfacing system, such as a computer; a pneumatic actuator, or an electronic motor.

Typically the apparatus further comprises one or more electrodes. The one or more electrodes may be arranged opposite the substrate support. The apparatus may further comprise one or more electrical contacts arranged to electrically contact the one or more electrodes and/or the semiconductor substrate. The apparatus may further comprise one or more fluid inlets. The apparatus may further comprise one or more fluid outlets. The apparatus may further comprise a seal configured to seal a peripheral portion of the semiconductor substrate so as to define the covered processing volume. The seal may form a fluid seal with the semiconductor substrate at a distance of 3 mm or less from the edge of the semiconductor substrate. The seal may be disposed in one of the side walls of the processing chamber. The seal may prevent fluid, such as electrolyte, from leaking and hence contaminating other components of the apparatus.

The apparatus may be an electrochemical processing chamber. The apparatus may be an electrochemical deposition chamber.

According to a second aspect of the invention there is a processing system comprising a vertical stack of a plurality of apparatus according to the first aspect of the invention.

Adjacent apparatus in the vertical stack may be spaced apart by a spacing of 200 mm or less, and optionally 150 mm or less.

According to a third aspect of the invention there is a method of processing a semiconductor substrate using the apparatus according to the first aspect of the invention, the method comprising the steps of:

forming a seal between the processing chamber and a peripheral portion of a semiconductor substrate so as to define the covered processing volume;

controlling the magnetic arrangement so as to change the magnetic field of the magnetic arrangement, wherein the magnetically responsive element is responsive to changes in the magnetic field of the magnetic arrangement so as to provide a reciprocating motion to the agitator; and performing a processing step on the semiconductor substrate whilst providing the reciprocating motion to the agitator.

The processing step may comprise a wet chemical processing step, such as an electrochemical deposition step, an electroless deposition step, a chemical etching step, an electrochemical polishing step. The processing step may be a cleaning step, a rinsing step, and/or a drying processing step.

The agitator may be spaced apart from the semiconductor substrate.

The agitator may be spaced apart from the semiconductor substrate by a distance of 1.5-30 mm, 2-20 mm, or 3-10 mm. A small spacing between the agitator and the semiconductor substrate improves mixing of electrolyte and improves the rate of mass transport to the substrate.

The agitator may reciprocate in a direction substantially parallel to the semiconductor substrate. The reciprocating motion typically has a velocity component that reciprocates along a first axis. The reciprocating motion may be a linear reciprocating motion. Optionally, the reciprocating motion may be a non-linear reciprocating motion or a have serpentine path. The reciprocating motion may comprise at least one other velocity component that is orthogonal to the first axis. For example, the reciprocating motion may have a second velocity component that reciprocates along a second axis, wherein the second axis is orthogonal to the first axis.

The reciprocating motion may have a speed of 5-30 cm $s^{-1}$.

The reciprocating motion may comprise a forward stroke and a backward stroke. The forward stroke may have a stroke speed and/or a stroke length that is different to a stroke speed and/or a stroke length of the backward stroke. That is, the reciprocating motion may be asymmetric. Using an asymmetric stroke pattern can avoid resonance effects. This helps to improve processing uniformity, such as deposition uniformity.

The agitator may comprise a plurality of paddles. Adjacent paddles in the plurality of paddles may be spaced apart by a paddle spacing. The reciprocating motion may have a stroke length of equal to or more than the paddle spacing.

Whilst the invention has been described above, it extends to any combination of the features set out above, or in the following description, drawings and claims. For example, any features disclosed in relation to one aspect of the invention may be combined with any features of any of the other aspects of the invention.

DESCRIPTION OF THE DRAWINGS

Embodiments of the invention will now be described, by way of example only, with reference to the accompanying drawings, in which.

DETAILED DESCRIPTION OF THE DISCLOSURE

Figure 1:
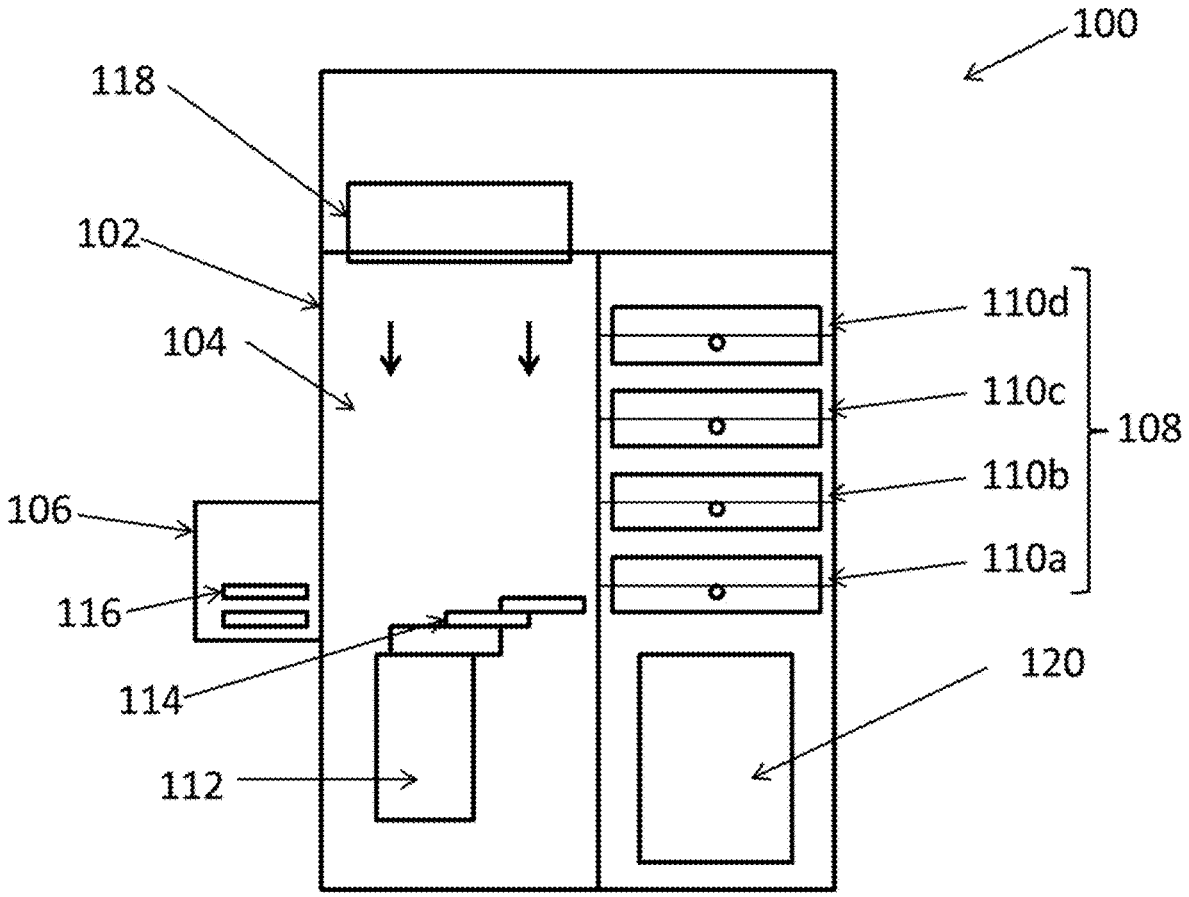
FIG. 1 is a schematic cross-sectional view of a substrate processing system.

The present inventors have considered various problems that are relevant to practical commercialisation of electrochemical processing chambers in previous applications EP2652178 A2, EP2781630 A1, and EP3352206 A1. The entire contents of these are all hereby incorporated by reference. FIG. 1 shows a substrate processing system 100 of the present invention. The substrate processing system may be of the type described in EP3352206 A1 (SPTS Technologies Limited).

The substrate processing system 100 comprises a frame 102 which defines a handling environment 104; a loading/ unloading port 106, and at least one vertical stack 108 of substrate processing modules 110*a-d*. FIG. 1 shows a single vertical stack 108. However, the substrate processing system 100 can have a plurality of vertical stacks. The vertical stack 108 shown in FIG. 1 comprises four processing modules 110*a-d*. The number of processing modules in each vertical stack 108 can be any number and is typically greater than three. The substrate processing modules 110*a-d* may each individually be suitable for one or more wet chemical processing steps, such as electrochemical deposition, electroless deposition, chemical etching, electrochemical polishing, and the like; and/or cleaning, rinsing, and/or drying processing steps.

A transfer robot 112 comprising an end effector 114 is disposed in the handling environment 104. The transfer robot 112 can transfer a substrate 116 on the end effector 114 between the loading/unloading port 106 and any substrate processing module 110*a-d*, and/or can transfer the substrate 116 between individual substrate processing modules 110*a-d*. The handling environment 104 is maintained substantially free of particles, for example by using a filtered air supply from a fan/filtration system 118, to avoid contamination of the substrate 116.

Fluid supplies, such as electrolyte supplies; and control equipment, such as pumps, filters and the like 120 are provided underneath or next to the substrate processing modules 110*a-b*.

Figure 2:
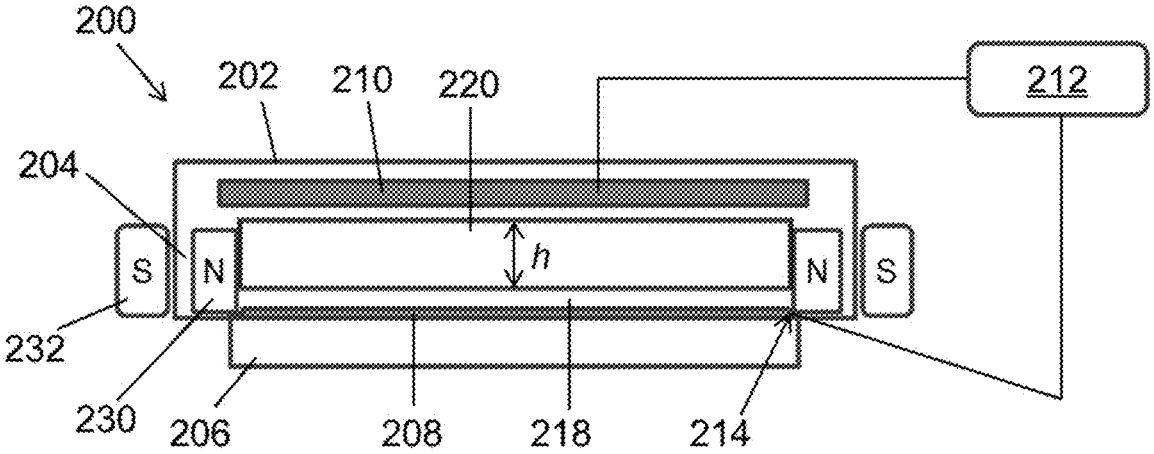
FIG. 2 is a schematic cross-sectional view of a substrate processing apparatus according to a first embodiment of the invention.
Figure 3:
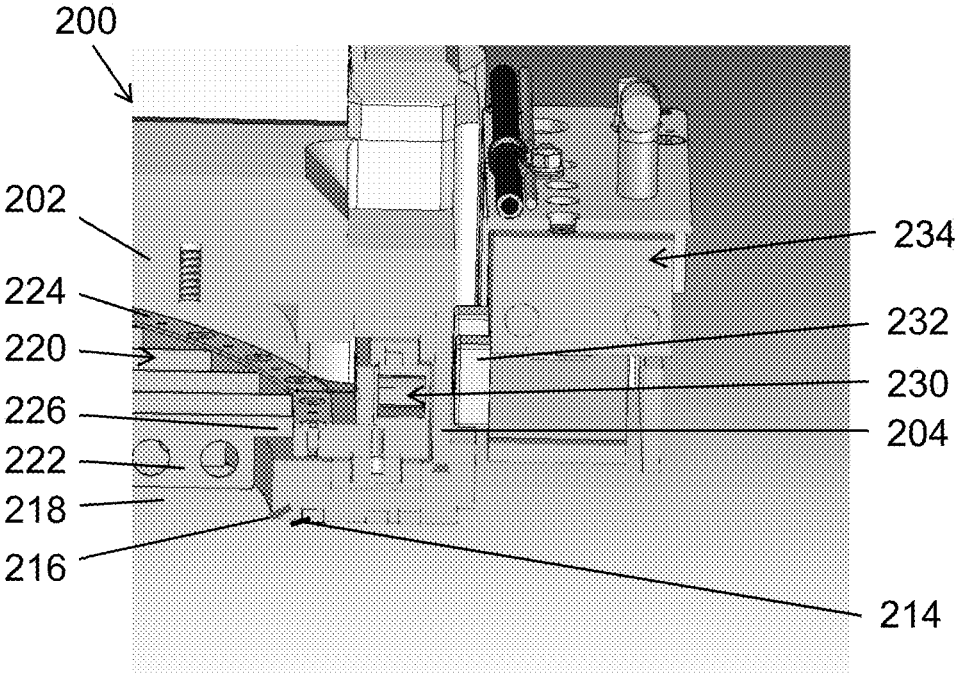
FIG. 3 is a partial cut-away view of a substrate processing apparatus according to the first embodiment without the substrate or substrate support shown.
Figure 4:
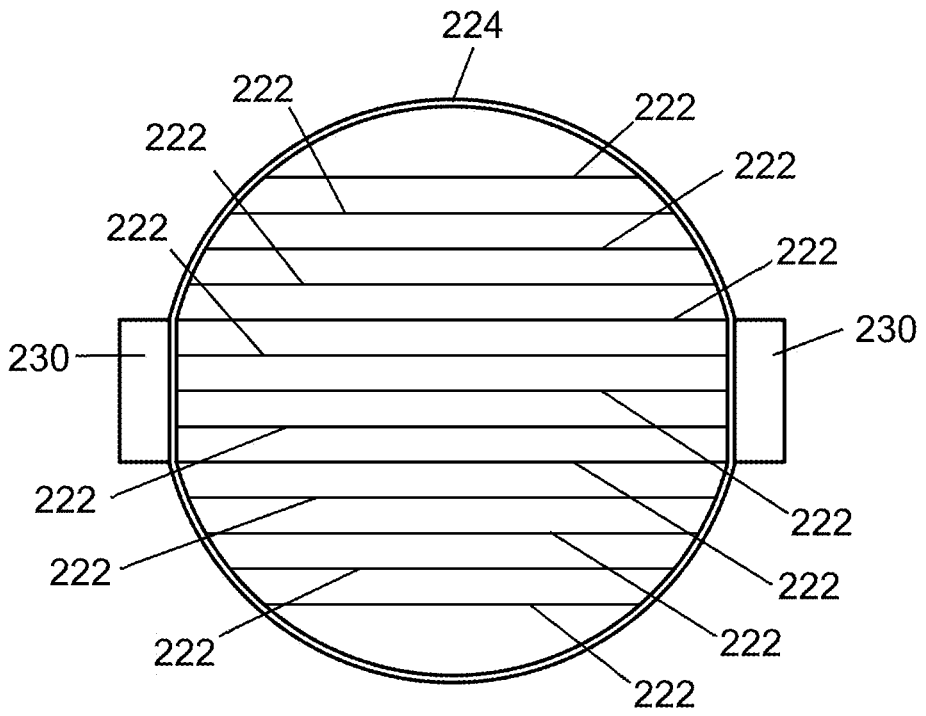
FIG. 4 is a schematic plan view of an agitator according to the first embodiment.

A substrate processing apparatus 200 suitable for electrochemically processing a semiconductor substrate will now be described with reference to FIGS. 2 and 3. The substrate processing apparatus 200 is adapted to be incorporated into the substrate processing system 100 as one of the substrate processing modules 110*a-d*.

The apparatus 200 comprises a processing chamber 202 having one or more side walls 204. In the first embodiment, the processing chamber 202 is an electrochemical processing chamber. The processing chamber 202 is typically substantially cylindrical, for example, when processing circular substrates. However, the processing chamber 202 can have any other geometry. For example, for rectangular shaped substrates, such as panels, the chamber can be substantially cuboid or box shaped. The processing chamber 202 is of the type that is sealable to a peripheral portion of a substrate 208 in order to define a covered processing volume 218. In the first embodiment, the height of the processing chamber 202 is less than 300 mm. The apparatus 200 is made using materials that are compatible with the electrolyte and reagents being used in the processing steps. Suitable materials include (but are not limited to): dielectric materials, such as polypropylene, polyvinyl chloride (PVC), polyether ether ketone (PEEK); or fluorinated polymers, such as polytetrafluoroethylene (PTFE) or perfluoroalkoxy alkane (PFA).

The apparatus 200 further comprises a substrate support 206, onto which a substrate to be processed 208 is positioned. The substrate support 206 supports the substrate substantially horizontally. The substrate 208 is a semiconductor substrate which acts as an electrode during electrochemical processing steps. For example, in an electrochemical deposition process, the substrate 208 acts as a cathode. The substrate 208 is typically present as a wafer, such as a silicon wafer. In the first embodiment, the front face of the substrate 208 faces upwards into the processing chamber. In an alternative embodiment, the front face of the substrate 208 faces downwards into the processing chamber 202.

A second electrode 210 is positioned opposite the substrate 208. In an electrochemical deposition process, the second electrode 210 is an anode. The anode can be a consumable or inert electrode. A DC power supply 212 is connected between the substrate 208 and the second electrode 210 via an Ohmic connection. The DC power supply can apply a potential difference between the substrate 208 and the second electrode 210. The Ohmic connection to the substrate 208 is typically made by a series or ring of Ohmic contacts 214 made at the periphery of the substrate, for example at about 1-1.5 mm from the substrate edge. The Ohmic contacts 214 are typically made from titanium, or a platinum coated titanium.

When a substrate 208 is being processed, the substrate 208 is brought into contact with a seal 216 situated at the base of the processing chamber 202. The seal 216 contacts a periphery of the substrate 208 to form a fluid seal between the substrate 208 and the processing chamber 202. The seal 216 contacts the substrate 208 within about 3 mm from the edge of the substrate 208. When the fluid seal is made, the walls 204 and the substrate 208 define a covered processing volume 218. During electrochemical processing, the covered processing volume 218 is filled with electrolyte. The fluid seal avoids electrolyte leaking from the covered processing volume 218 during processing. This helps to avoid contamination of the backside of the substrate 208 and other components of the apparatus 200. The seal 216 is made from an inert material, for example an inert elastomeric material, such as Viton™.

The apparatus 200 further comprises a fluid agitation means, such as an agitator 220. An agitator is a device for stirring a fluid, such as a liquid, solution or electrolyte. In the first embodiment, the agitator is a paddle assembly. The agitator 220 is disposed inside the processing chamber 202. The agitator 220 comprises one or more paddles, fins or blades 222. A plurality of blades 222 are typically arranged parallel to each other with a pre-determined spacing between adjacent blades. The spacing between adjacent blades 222 is determined by the hydrodynamic requirements of the processing step. The blades 222 can be made from a metallic material or insulating material. The blades 222 are held in close proximity to (but spaced apart from) the substrate 208 being processed. Each blade 222 is supported on a frame 224 by a tab 226 at each end of the blade 222. Fixing the blade 222 to the frame 224 in this way allows the vertical spacing between the blades 222 and the substrate 208 during processing to be precisely controlled and maintained at a fixed, pre-determined spacing. The substrate 208 and the blades 222 can have a spacing of 1.5 mm-30 mm, 2 mm-20 mm, or 3 mm-10 mm. The substrate 208 and the blades 222 can be spaced apart at a pre-determined distance between any combinations of these ranges. The height of the blades (represented by the double headed arrow marked h on FIG. 2) can be about 10-50% the distance between the substrate 208 and the second electrode 210.

The agitator 220 is configured to move with a reciprocating motion (i.e. oscillate backwards and forwards). A reciprocating motion has a forward stroke and a backward stroke, each having a stroke speed and stroke length. The agitator 220 reciprocates in a direction parallel to the substrate 208 and substrate support 206. The present inventors have found that a combination of the precise positioning of the agitator 220 and its reciprocating motion allow a low volume of electrolyte to be mixed efficiently. Additionally, the reciprocating motion of the agitator 220 helps to increase the rate of mass transport of electrolyte to the substrate 208 surface (i.e. the electrode surface). This decreases the diffusion boundary layer thickness and helps to increase the rate of a (mass transport limited) electrochemical reaction.

For example, the reciprocating motion of the agitator 220 can help to increase the rate of deposition in an electrochemical deposition process. Additionally, the reciprocating motion of the agitator 220 helps to ensure the mass transport is uniform across the entire surface of the substrate (electrode). This results in a uniform coating being deposited during electrochemical deposition.

The agitator comprises a magnetically responsive element 230. The magnetically responsive element 230 is disposed inside the processing chamber 202. The magnetically responsive element 230 can be a magnetic material, such as a magnetically susceptible metal; or a magnet, such as a permanent magnet, an electromagnet, or an array of magnets. Preferably, the magnetically responsive element 230 is a permanent magnet. Preferably, the apparatus 200 comprises a pair of magnetically responsive elements arranged so that each magnetically responsive element 230 is attached to an opposite side of the agitator 220. The magnetically responsive elements in the pair of magnetically responsive elements are typically diametrically opposed across the processing volume 218. The (or each) magnetically responsive element 230 typically has an associated magnetic field. In the first embodiment, the apparatus 200 comprises a pair of permanent magnets arranged at opposite ends of the blades 222 or tabs 226 and attached thereto, which function as a pair of magnetically responsive elements 230. Movement of the magnetically responsive element 230 causes movement of the agitator 220.

A magnetic arrangement 232, which produces a magnetic field, is positioned outside of the processing chamber 202. The magnetic arrangement 232 can be a permanent magnet, an electromagnet, or an array of magnets. Preferably, the apparatus 200 comprises a pair of magnets 232 disposed at opposite sides of and outside the processing chamber 202. The position of the magnetic arrangement 232 outside of the processing chamber 202 typically corresponds to the arrangement of magnetically responsive elements disposed within the process chamber 202. The magnetic field of the magnetic arrangement 232 couples to the magnetically responsive element 230. Minimising the distance between the magnetic arrangement 232 and the magnetically responsive element 230 can increase the strength of the magnetic coupling between them. The polarity of the magnetic field is tuned so that the magnetic coupling between the magnetic arrangement 232 and the magnetically responsive element 230 is maintained. In some embodiments the polarity of the magnetically responsive element 230 and the polarity of the magnetic arrangement 232 are tuned to maintain tight magnetic coupling. For example, the polarity of the magnetic arrangement can be the opposite to the polarity of the magnetically responsive element. Consequently, a change in the magnetic field of the magnetic arrangement 232 can cause the magnetically responsive element 230 to move. For example, a change in the position of the magnetic arrangement 232 can cause the position of the magnetically responsive element 230 to change, thereby moving the agitator 220. In another embodiment, the change in the magnetic field can be a change in the magnitude of the magnetic field.

In the first embodiment, a pair of permanent magnets 232 are positioned adjacent an exterior of opposing chamber side walls 204. The magnets 232 magnetically couple to the pair of magnetically responsive elements 230 through the chamber side walls 204. However, the magnet arrangement 232 can be positioned above or below the processing chamber 202 so that the magnetic arrangement 232 magnetically couples to the magnetically responsive element 230 through a top or bottom of the processing chamber 202. Using a pair of magnets 232 and a pair of magnetically responsive elements 230 in this way enables a stronger magnetic coupling, and hence a greater force, to drive the movement of the agitator 220. The thickness of the chamber walls through which magnetic coupling occurs can be thinned relative to the remainder of the chamber walls to increase the strength of the magnetic coupling between the magnetic arrangement 232 and the magnetically responsive element 230. For example, the thinned chamber wall (through which magnetic coupling occurs) is typically about 3-10 mm, and optionally about 5 mm. The magnetic arrangement 232 and the magnetically responsive element 230 are positioned close to the thinned chamber wall. Preferably, the distance between the magnetic arrangement 232 and the magnetically responsive element 230 is minimised.

In the first embodiment, a motion producing controller 234 is used to drive the movement of the magnetic arrangement 232 in the reciprocating motion. The controller 234 can be a pneumatic actuator, or an electronic motor.

In operation, the controller 234 moves the magnetic arrangement 232 backwards and forward in a reciprocating motion. The reciprocating motion of the magnetic arrangement 232 causes the magnetically responsive element 230 to move in synchrony. In turn, this causes the agitator 220 to move in a reciprocating motion thereby mixing electrolyte within the processing chamber 202.

Driving the movement of the agitator 220 in this way provides excellent agitation of electrolyte within the processing chamber 202. Using magnetic coupling also allows the processing space 212 to be sealed and enclosed without the need to have moving parts extending through a chamber wall. The benefits here are twofold. Firstly, this allows the processing chamber 202 to be isolated from the surroundings, which helps to avoid contamination. Secondly, it is very difficult to maintain a reliable fluid seal where a moving part extends through a chamber wall, and therefore the risk of leaks (which also lead to contamination) is further reduced.

The length of the forward and backward strokes of the agitator is typically determined by the separation between adjacent blades 222. The stroke length is preferably the same as or greater than the separation between adjacent blades 222. Preferably, the reciprocating motion is asymmetric to avoid resonance effects occurring. For example, the speed of the forward stroke can be faster (or slower) than the speed of the backwards stroke. In operation, the agitator has a velocity of about 5-30 cm $s^{-1}$.

A Hall sensor (not shown) can be used to monitor the position of a magnet embedded in the agitator 220. A Hall sensor can provide real-time monitoring of the position of the agitator 220. A Hall sensor is a transducer that varies its output in response to a magnetic field, and can be used to measure the magnitude of a magnetic field. By monitoring the position of the agitator 220 in real-time, it is possible to accurately control the agitator 220 motion, such as agitator frequency and velocity. This helps to improve the uniformity and rate of mass transport of fluid, such as electrolyte, to the surface of the substrate being processed.

The invention claimed is:

1. An apparatus for electrochemically processing a semiconductor substrate, the apparatus comprising:

a processing chamber that is sealable to a peripheral portion of a semiconductor substrate so as to define a covered processing volume;

a substrate support for supporting the semiconductor substrate;

a magnetic arrangement disposed outside of the processing chamber, the magnetic arrangement producing a magnetic field;

a controller for controlling the magnetic arrangement so as to change the magnetic field; and an agitator disposed within the processing chamber, the agitator comprising a magnetically responsive element which is responsive to changes in the magnetic field of the magnetic arrangement through a side wall of the processing chamber so as to provide a reciprocating motion to the agitator.

2. The apparatus according to claim 1, in which the magnetically responsive element comprises at least one permanent magnet.

3. The apparatus according to claim 1, in which the magnetically responsive element is responsive to changes in a position of the magnetic field of the magnetic arrangement.

4. The apparatus according to claim 1 in which the side wall through which the magnetically responsive element is responsive to changes in the magnetic field has a thickness of less than the thickness of another side wall of the processing chamber.

5. The apparatus according to claim 1 in which the side wall through which the magnetically responsive element is responsive to changes in the magnetic field has a thickness of 3-10 mm.

6. The apparatus according to claim 1, in which the magnetically responsive element and the magnetic arrangement have a separation of less than 30 mm, less than 25 mm, less than 20 mm, or less than 10 mm.

7. The apparatus according to claim 1, in which the agitator comprises two magnetically responsive elements arranged to be adjacent to opposing side walls of the processing chamber, wherein each magnetically responsive element is responsive to changes in the magnetic field of the magnetic arrangement so as to provide a reciprocating motion to the agitator.

8. The apparatus according to claim 1, in which the magnetic arrangement comprises a permanent magnet, an electromagnet, or a magnetic array.

9. The apparatus according to claim 1, in which the agitator further comprises at least one paddle.

10. The apparatus according to claim 9, in which the at least one paddle is a plurality of paddles, and adjacent paddles in the plurality of paddles are spaced apart by a regular spacing.

11. The apparatus according to claim 1, in which the agitator comprises a tab that is received by a complementary portion of the processing chamber to support the agitator.

12. The apparatus according to claim 11, in which the tab comprises the magnetically responsive element.

13. The apparatus according to claim 1, in which the agitator is made from a metallic material; a dielectric material; or a plastic material.

14. The apparatus according to claim 1, in which the substrate support supports the semiconductor substrate horizontally thereon, optionally with a front face of the semiconductor substrate to be processed facing upwards.

15. The apparatus according to claim 1, in which the processing chamber has a cross-sectional dimension of less than 300 mm or less than 200 mm.

16. A processing system comprising a vertical stack of a plurality of apparatuses according to claim 1.

17. The processing system of claim 16, in which the apparatuses that are adjacent in the vertical stack are spaced apart by a spacing of 200 mm or less, and optionally 150 mm or less.

* * * * *